US005833530A

United States Patent [19]

Kuo

[11] Patent Number: 5,833,530

[45] Date of Patent: Nov. 10, 1998

[54] ELECTRICITY-FREE ROTARY WIND BLOWING APPARATUS

[76] Inventor: Jin-Yu Kuo, 1F, No. 31, Sec. 4, Chunghsin Rd., Sancaung, Taipei Hsien, Taiwan

[21] Appl. No.: 825,706

[22] Filed: Mar. 19, 1997

[51] Int. Cl.[6] ..... F24F 12/075

[52] U.S. Cl. ..... 454/285

[58] Field of Search ..... 454/202, 208, 454/285, 292, 244, 300; 415/125, 146

[56] References Cited

U.S. PATENT DOCUMENTS

| | | | |
|---|---|---|---|
| 2,824,429 | 2/1958 | Zucker | 62/427 |
| 4,425,840 | 1/1984 | Masao | 454/285 X |
| 4,616,563 | 10/1986 | Toohey | 454/285 |
| 4,878,620 | 11/1989 | Tarleton | 454/285 X |

*Primary Examiner*—Harold Joyce
*Attorney, Agent, or Firm*—Bacon & Thomas

[57] ABSTRACT

An electricity-free rotary wind blowing apparatus including a wind guiding device, a spreading device and a supporting device. The supporting device has a central seat portion disposed with an inner bearing. The spreading device is rotatable secured to the bearing. The wind guiding device has a central shaft seat and a peripheral rim. Multiple radial inclined wind guiding vanes are disposed between the shaft seat and the peripheral rim. The air flow blows from the wind exit of a wind pipe of an air-conditioning system onto the vanes and is guided thereby so as to exert a rotating force onto the spreading device, whereby the spreading device itself is rotatably driven by the air flow without using electricity to evenly spread the air flow.

14 Claims, 11 Drawing Sheets

ELECTRICITY-FREE ROTARY WIND BLOWING APPARATUS

BACKGROUND OF THE INVENTION

The present invention relates to an electricity-free rotary wind blowing apparatus including a wind guiding device for guiding air flow to impact a spreading device so as to rotate the same without using electricity and in order to evenly spread the air flow.

A central air-conditioning system through multiple air pipelines transfers cold air or heated air to each corner. A wind guiding device is generally disposed at the wind exit of the pipeline. Such wind guiding device is composed of many inclined vanes symmetrically arranged about the center. Therefore, the vanes serve to spread the cold or heated air over the room.

However, when the cold air is blown downward from the horizontal portion of the wind pipeline, the cold air is stopped by the end thereof and turns 90 degrees. At this time, due to inertia, most of the cold air will be concentrated on the outer side of the pipeline and blown from one side of the wind exit. In addition, the inclined vanes of such wind exit are fixed so that the cold air is blown in a fixed direction. Accordingly, such conventional wind guiding device cannot evenly spread the cold air.

SUMMARY OF THE INVENTION

It is therefore a primary object of the present invention to provide a wind blowing apparatus which can be rotated to spread the cold air by means of the air flow at the wind exit itself. A spreading device is rotatably supported by a bearing of a supporting device. The spreading device is synchronously connected with a wind guiding device, whereby when the air flow blows onto the wind guiding device, the wind guiding device is rotated so as to synchronously rotate the spreading device without using electricity. Accordingly, the air flow can be evenly spread over the room.

It is a further object of the present invention to provide the above wind blowing apparatus in which the spreading device is rotatably connected with the bearing of the supporting device and the wind guiding device serves to guide the air flow to impact the spreading device so as to rotate the same itself for spreading the air flow.

The present invention can be best understood through the following description and accompanying drawings, wherein:

DETAILED DESCRIPTION OF THE PREFERRED EMBODIMENTS

Figure 1:
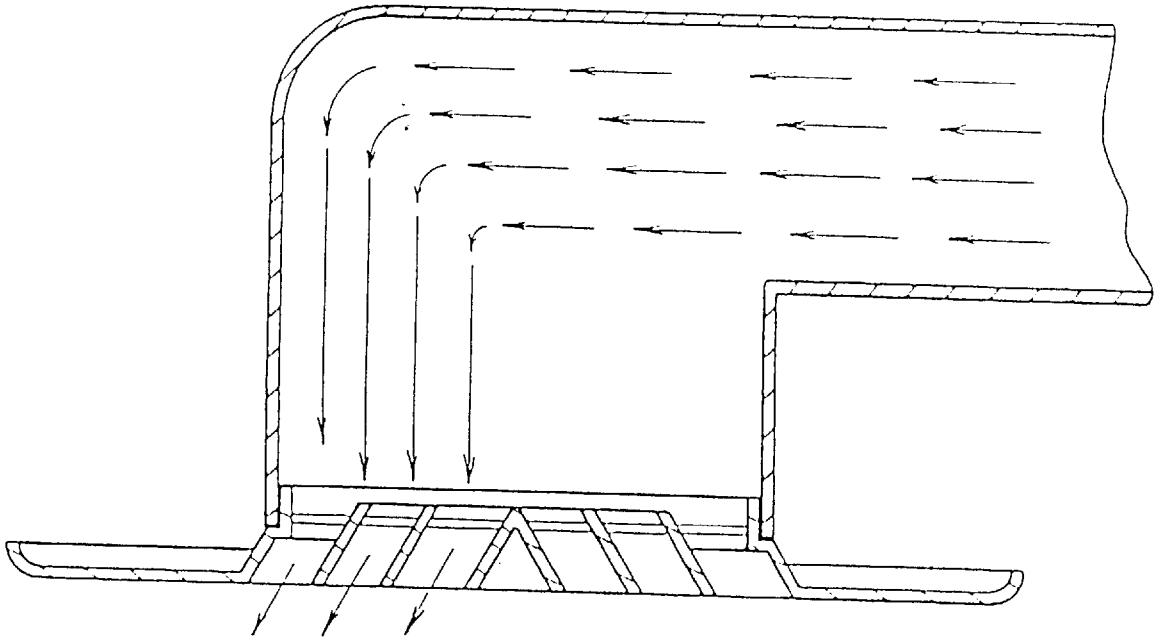
FIG. 1 Prior Art
FIG. 1 is a sectional view showing the conventional wind guiding device.

The present invention mainly includes a wind guiding device 10, a spreading device 20 and a supporting device 30. The supporting device 30 has a central seat portion 31 disposed with an inner retaining member 32 (such as a bearing). The spreading device 20 is secured to the retaining member 32. The wind guiding device 10 guides the air flow to blow and drive the spreading device 20 or itself is rotarily driven by the air flow to further synchronously drive the spreading device 20. Accordingly, the spreading device 20 itself can rotate without using electricity to spread the air flow.

Figure 2:
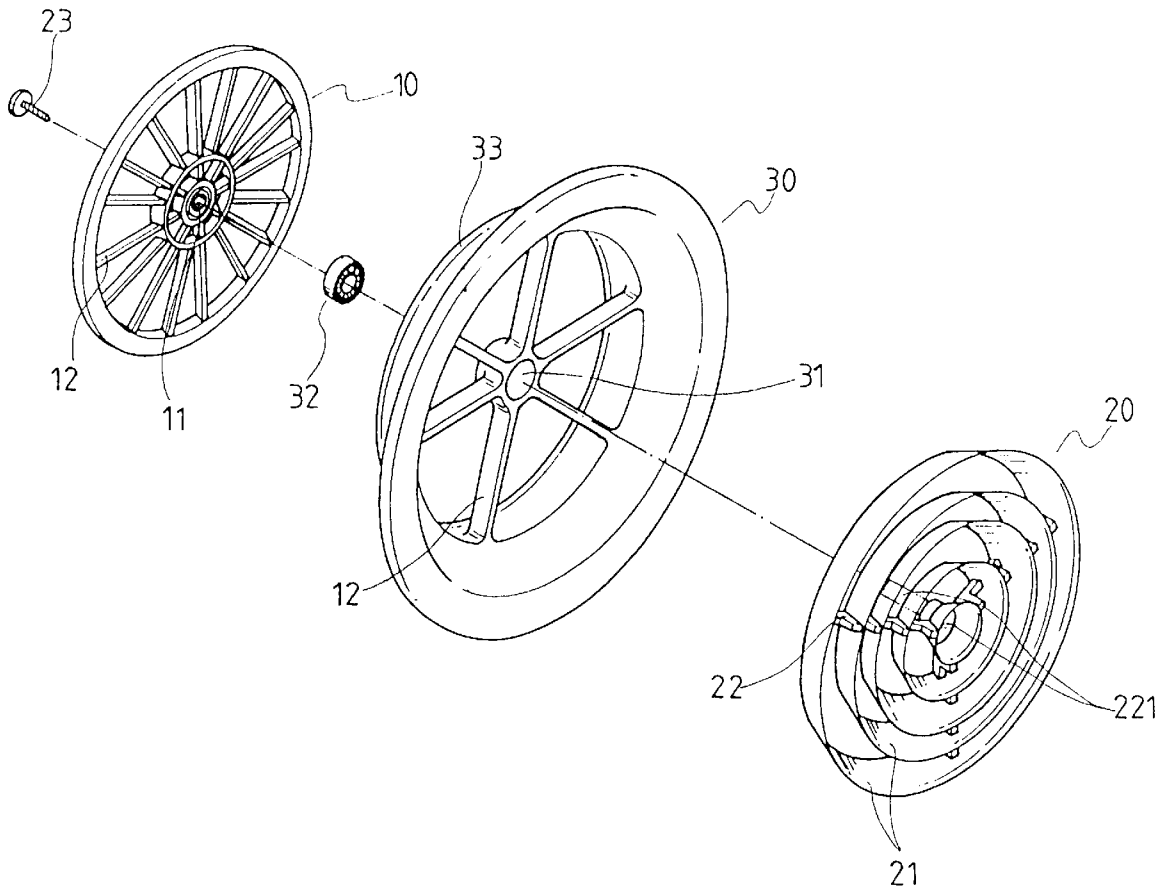
FIG. 2 is a perspective exploded view of a first embodiment of the present invention.
Figure 3:
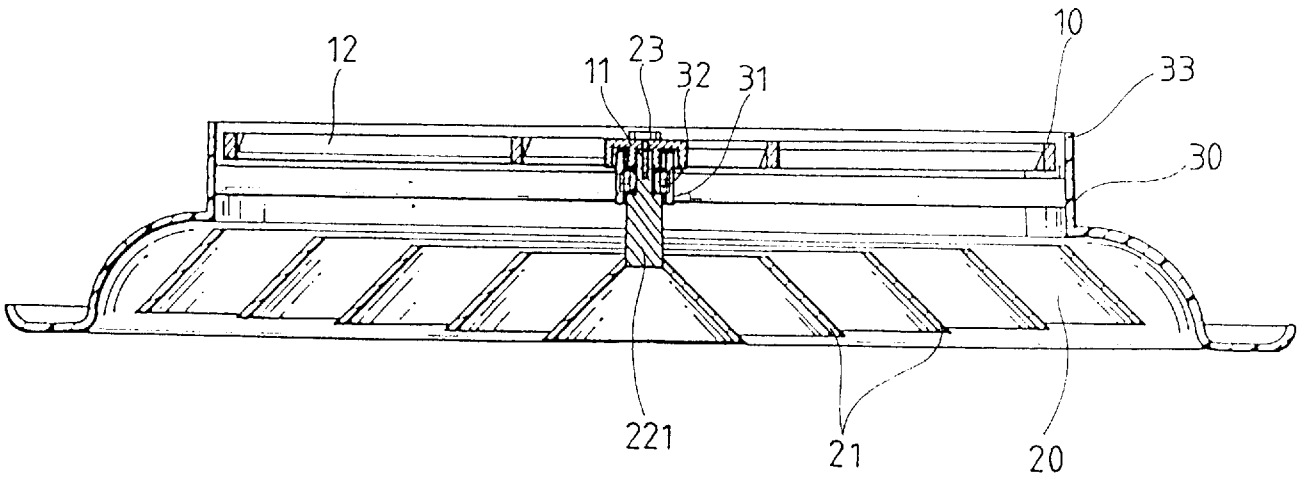
FIG. 3 is a sectional assembled view according to FIG. 2.

Please refer to FIGS. 2 and 3. The first preferred embodiment of the present invention includes a wind guiding device 10, a spreading device 20 and a supporting device 30.

The wind guiding device 10 is a wheel-like body having a central shaft seat 11 and a peripheral rim. Multiple radial inclined wind guiding vanes 12 are disposed between the shaft seat 11 and the peripheral rim. When blown by wind, the vanes 12 are pushed to rotate the wind guiding device 10.

The spreading device 20 has multiple inner concentrical annular inclined spreading plates 21. Between each two spreading Plates 21 are disposed spaced supporting ribs 22 for securing the spreading plates 21 together. The spreading device 20 has a central shaft seat 221 fixedly secured to the shaft seat 11 of the wind guiding device 10 by a fastening member 23 to synchronously rotate therewith.

The supporting device 30 is also a wheel-like body having a central seat portion 31 rotatable connected with the fastening member 23 between the wind guiding device 10 and the spreading device 20, whereby the wind guiding device 10 and the spreading device 20 can be supported by and rotated about the seat portion 31. The seat portion 31 is disposed with a retaining member 32 for smoothening the rotation.

Please refer to FIG. 3. The top of the supporting device 30 is disposed with an upward extending fitting portion 33 for connecting with a wind pipe of an air-conditioning system.

After it has been assembled, the above apparatus is used in such a manner that when wind blows into the assembly, the wind first flows through the wind guiding device 10 and the vanes 12 thereof are pushed by the wind to rotatably drive the wind guiding device 10. Synchronously, the spreading device 20 also rotates therewith. After the wind is cut and spread by these two devices, it is output in a downward inclined direction in accordance with the rotation of the spreading device 20. Therefore, an even, smooth and multi-directional wind is created to effectively spread the air-conditioning effect.

It should be noted that the wind guiding device itself is rotated by means of the wind force of the wind pipe without using any motor and externally connected power wire. Therefore, it becomes easy to install the air-conditioning system in a working site.

Figure 4:
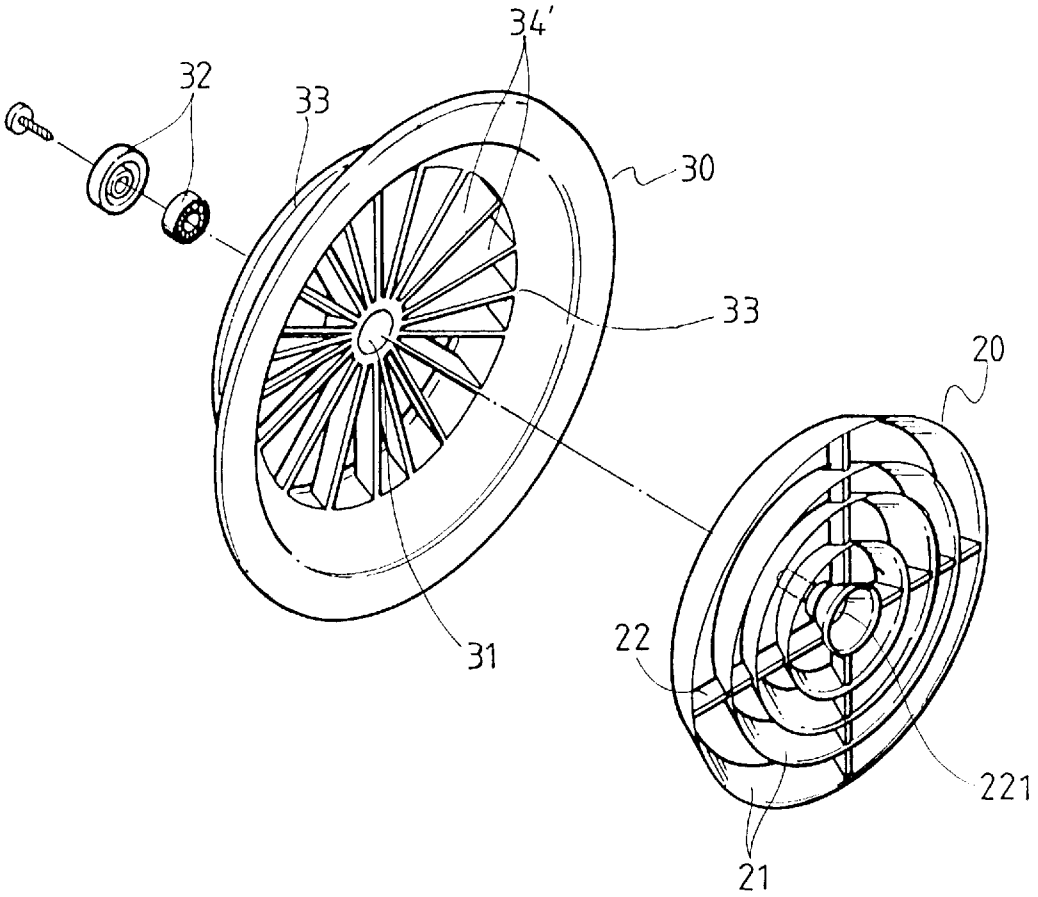
FIG. 4 is a perspective exploded view of a second embodiment of the present invention.
Figure 5:
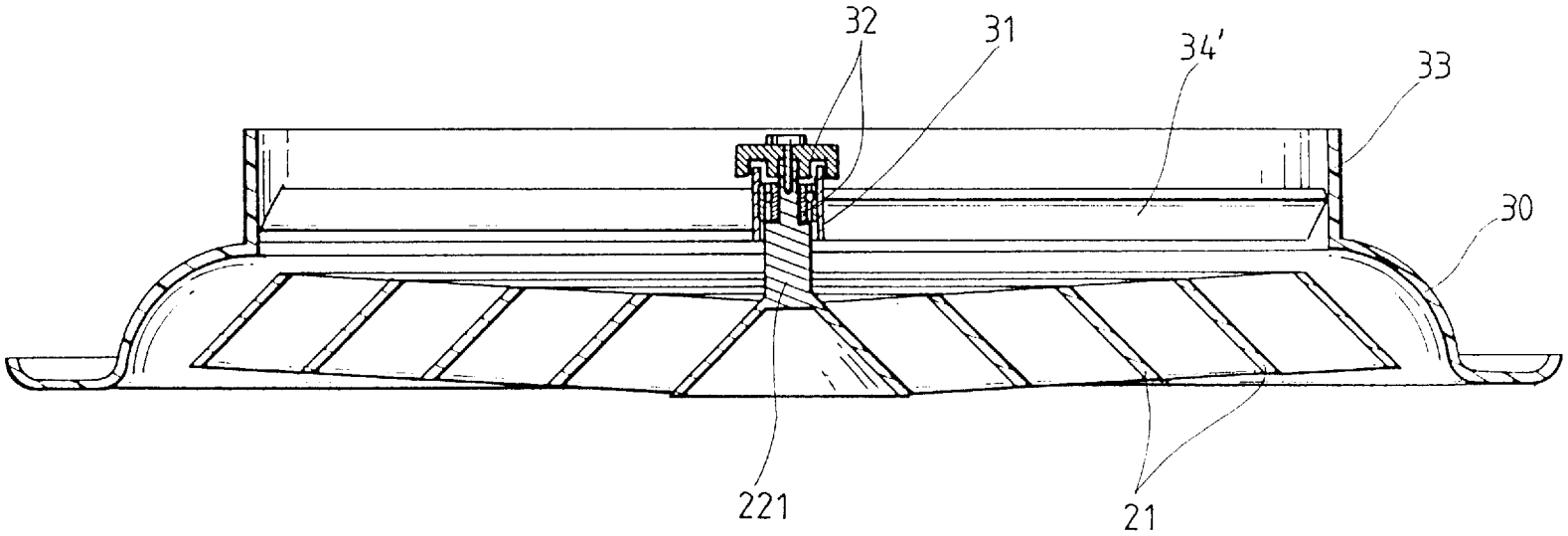
FIG. 5 is a sectional assembled view according to FIG. 4.

FIGS. 4 and 5 show a second embodiment of the present invention, wherein a part of the wind guiding device 10 is combined with the supporting device 30, that is, the supporting ribs 34 between the seat portion 31 of the supporting device 30 and the outer fitting portion 33 are designed into inclined vanes 34' and the spreading device 20 is directly rotatably connected with the seat portion 31 by the retaining member 32. Therefore, when the air flow passes through the inclined vanes 34', the air flow is guided to blow out in an inclined direction onto the spreading plates 21 and radial supporting ribs 22 of the spreading device 20 so as to rotarily-drive the spreading device 20.

Figure 6:
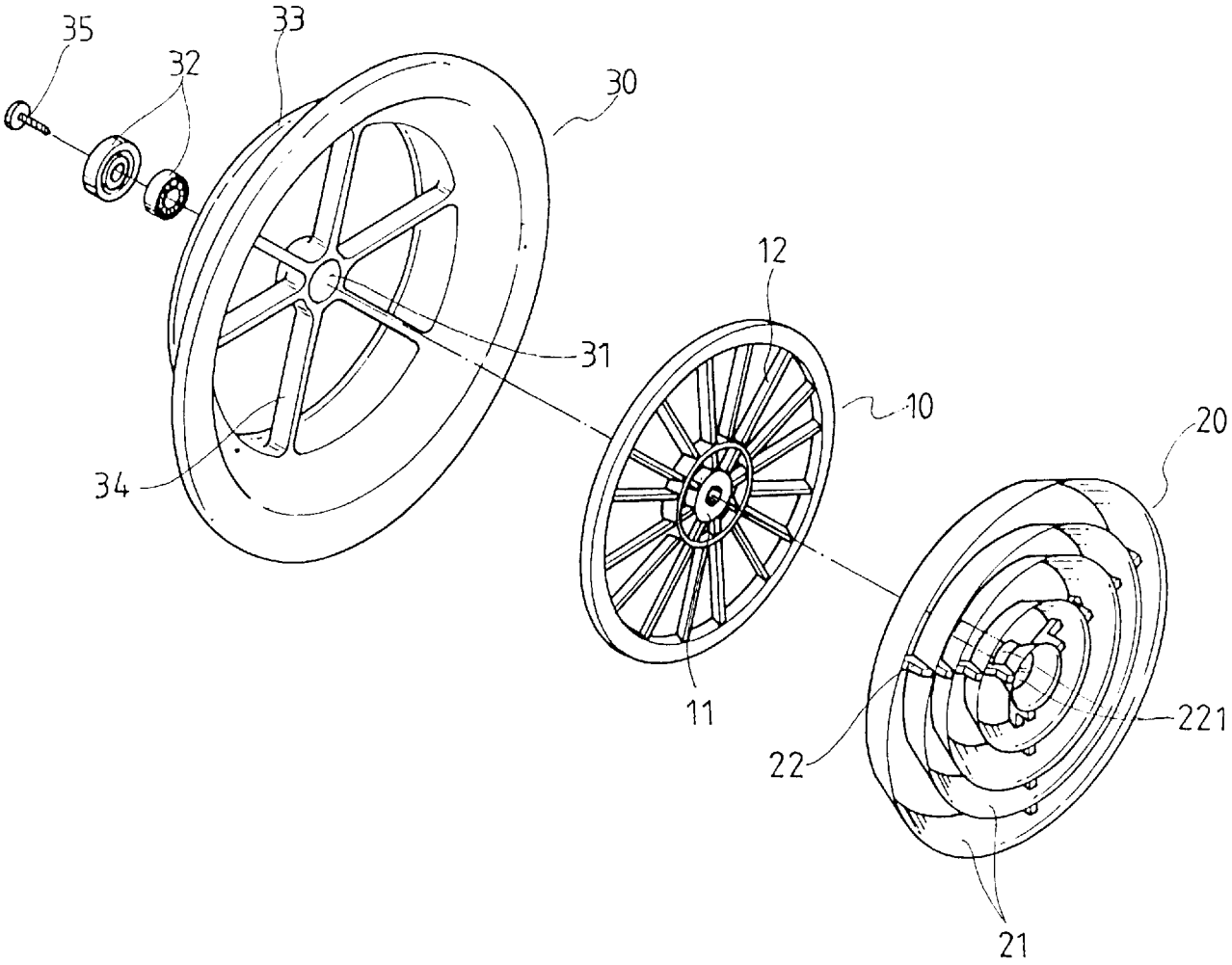
FIG. 6 is a perspective exploded view of a third embodiment of the present invention.
Figure 7:
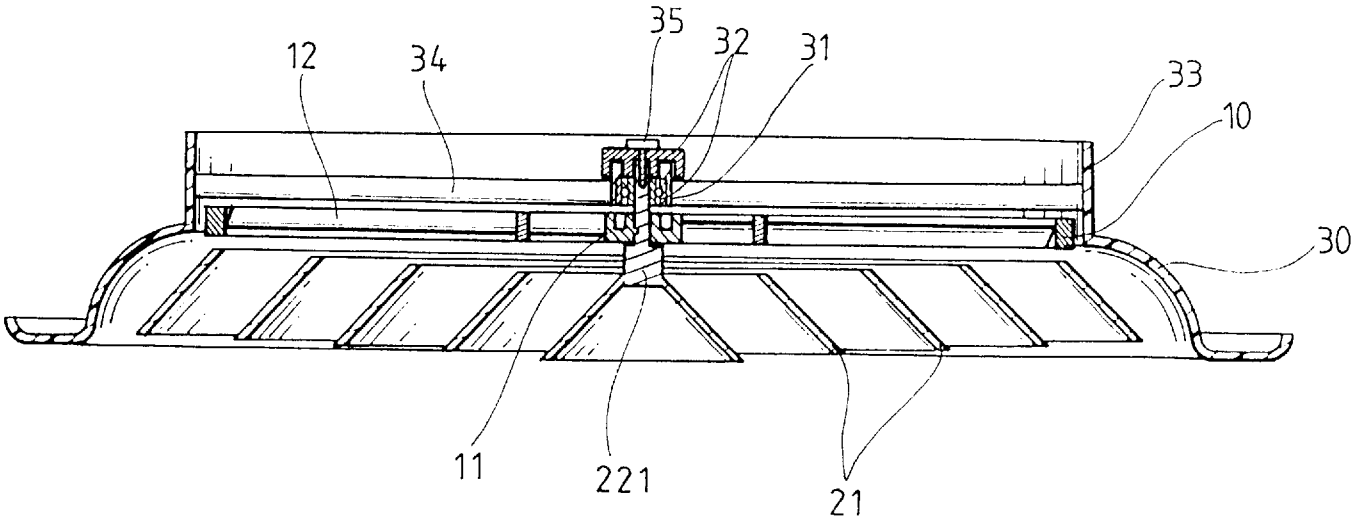
FIG. 7 is a sectional assembled view according to FIG. 6.

FIGS. 6 and 7 show a third embodiment of the present invention, wherein the supporting device 30 has a seat portion 31 and several radial supporting ribs 34 connected therewith. A retaining member 32 is disposed in the seat portion 31. The spreading device 20 has multiple concentrical annular inclined spreading plates 21 and a central shaft seat 11. The wind guiding device 10 is disposed with multiple radial wind guiding vanes 12. When assembled, the rotary shaft 24 of the spreading device 20 is passed through and tightly fitted with the shaft seat 11 of the wind guiding device 10. Then the rotary shaft 24 is extended into the retaining member 32 of the supporting device 30 to be fastened at one end by a fastening member 35, whereby the rotary shaft 24 is located in the retaining member 32, thus permitting the wind guiding device 10 and the spreading device 20 to synchronously rotate. When the wind blows from the wind exit onto the wind guiding vanes 12 of the wind guiding device 10, a force is exerted onto the wind guiding device 10 to rotate the same. At this time, the spreading device 20 synchronously rotate therewith so as to evenly spread the air-conditioning effect.

Figure 8:
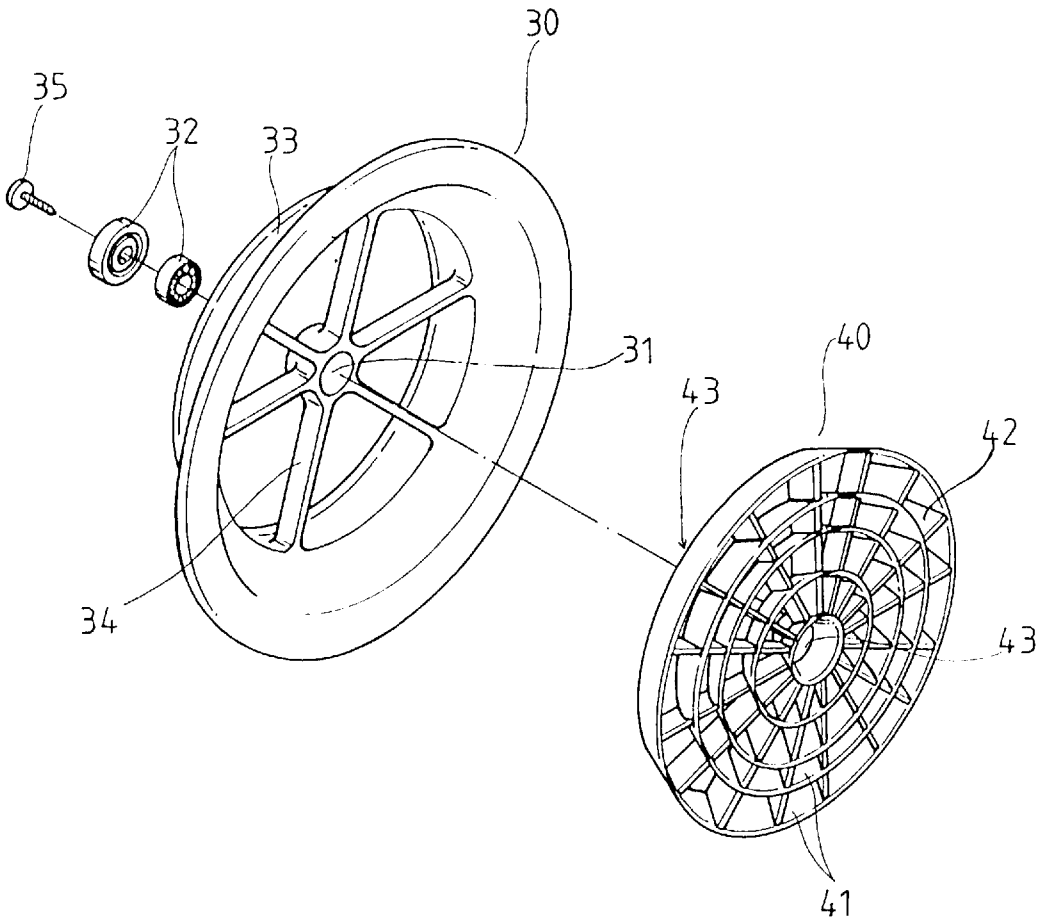
FIG. 8 is a perspective exploded view of a fourth embodiment of the present invention.
Figure 9:
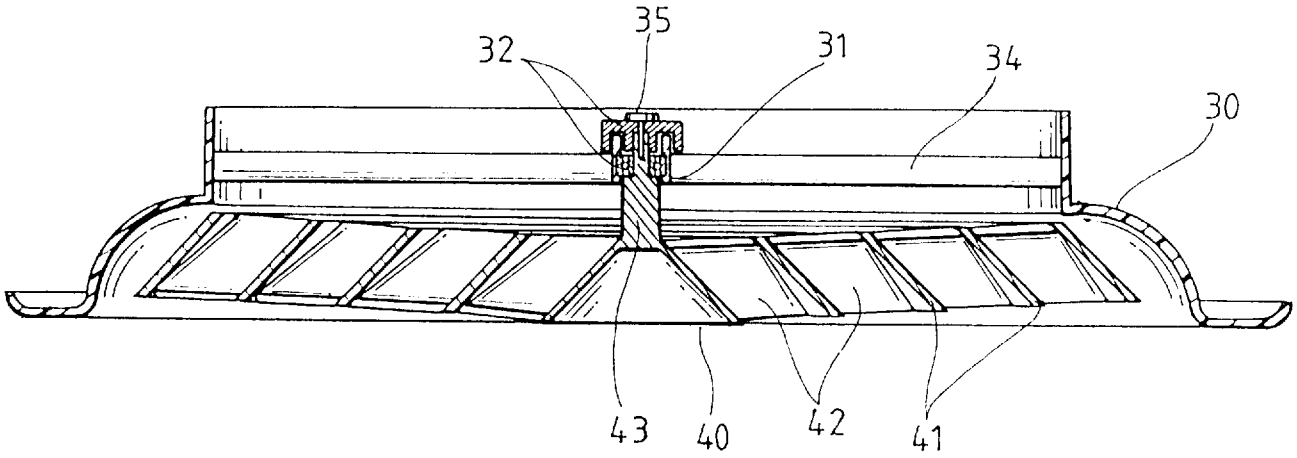
FIG. 9 is a sectional assembled view according to FIG. 8.

FIGS. 8 and 9 show a fourth embodiment of the present invention, wherein the spreading device 20 and the wind guiding device 10 are combined into a spreading wind guiding device 40 which has multiple concentrical annular spreading guiding plates 41 and radial inclined vanes 42 interlacedly disposed between the spreading guiding plates 41. The spreading guiding device 4 has a central rotary shaft 43 fitted into the retaining member 32 of the supporting device 30 to be fastened at one end by a fastening member 35 so as to locate the rotary shaft 43 on the retaining member 32. When the air flow blows from the wind exit onto the inclined vanes 42, a rotating force is created and exerted thereonto to rotate the spreading guiding device 40 and in cooperation with the spreading effect of the spreading guiding plates 41, the air-conditioning effect is evenly spread.

Figure 10:
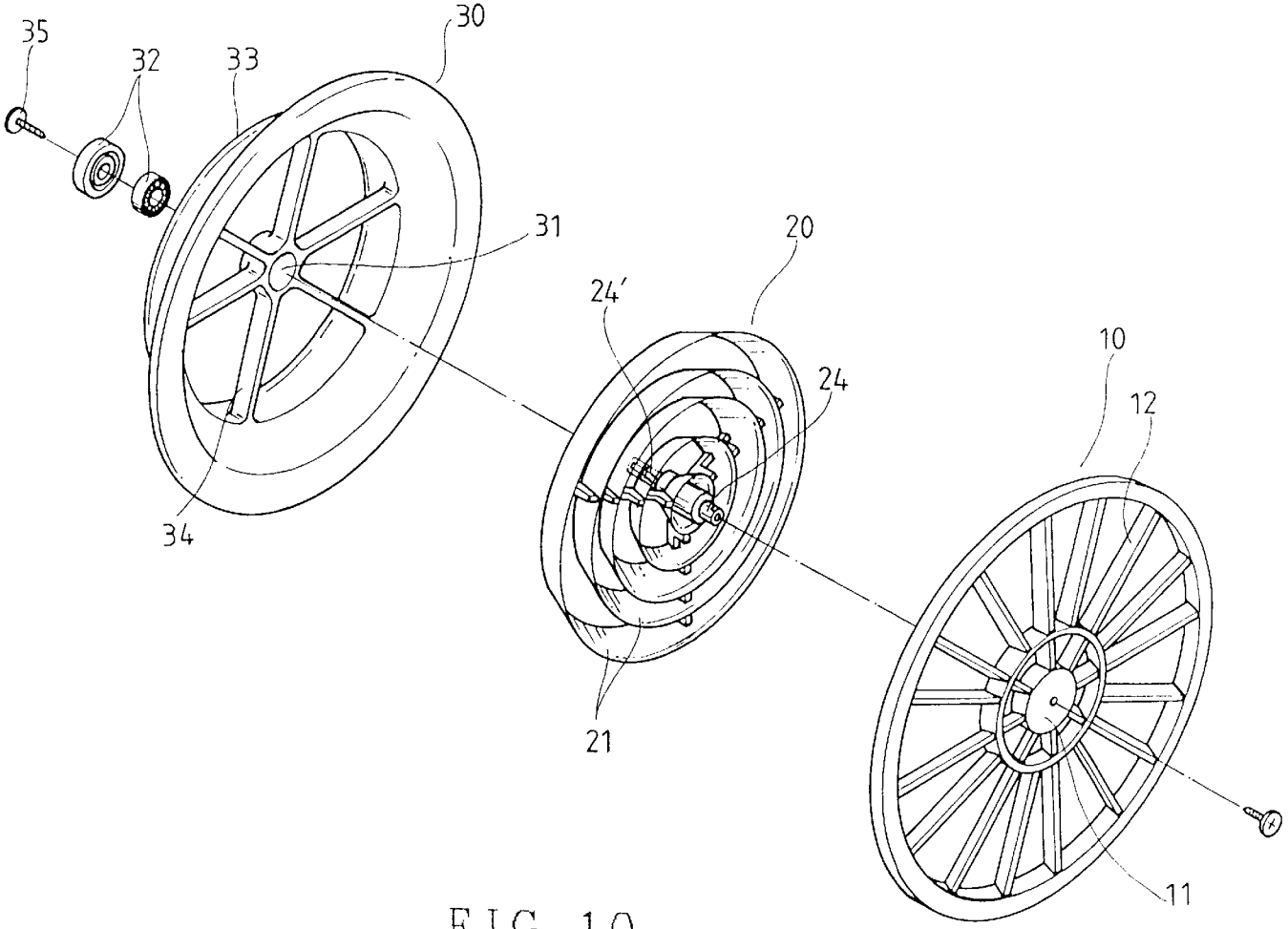
FIG. 10 is a perspective exploded view of a fifth embodiment of the present invention.
Figure 11:
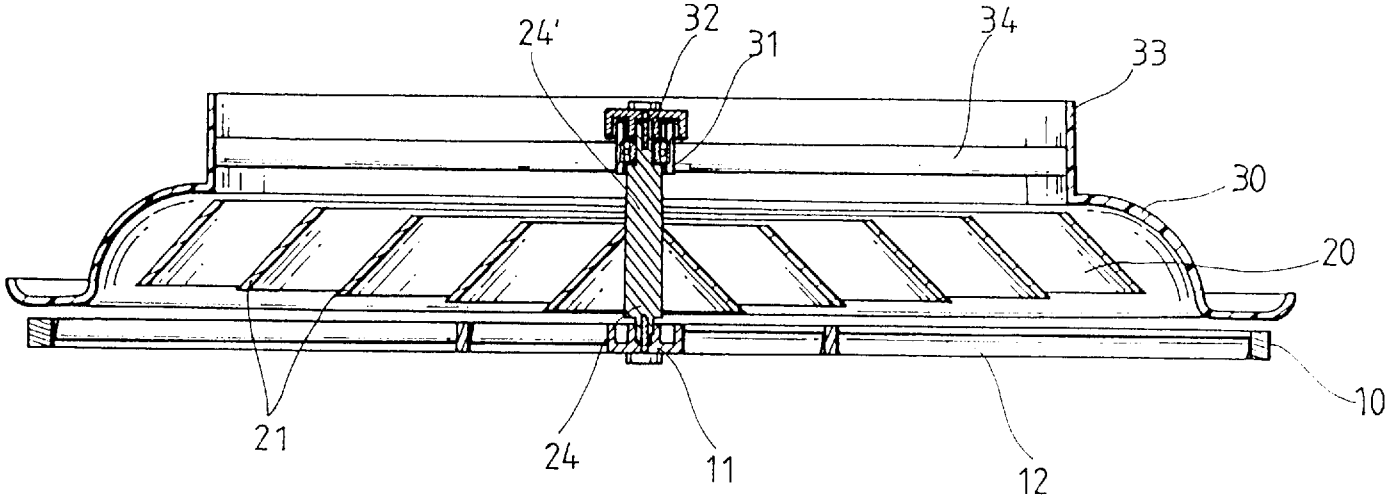
FIG. 11 is a sectional assembled view according to FIG. 10.

FIGS. 10 and 11 show a fifth embodiment of the present invention, wherein the spreading device 20 has a central rotary shaft 24, 24' protruding forward and rearward for passing through the central shaft seat 11 of the wind guiding device 10 to be locked therewith. The rear end of the rotary shaft 24' of the spreading device 20 passes through the retaining member 32 of the supporting device 30 to be fastened at one end by a fastening member 35 so as to locate the rear end of the rotary shaft 24' on the retaining member 32. Therefore, the wind guiding device 10 and the spreading device 20 can synchronously rotate to achieve an evenly spread wind blowing effect.

It should be noted that the above description and accompanying drawings are only used to illustrate some embodiments of the present invention, and are not intended to limit the scope thereof. Any modification of the embodiments should fall within the scope of the present invention.

What is claimed is:

1. An electricity-free rotary wind blowing apparatus comprising:

a wind guiding device having a central shaft seat and a peripheral rim, multiple radial inclined wind guiding vanes being disposed between the shaft seat and the peripheral rim;

a spreading device having multiple inner concentrical annular inclined spreading plates and between each two spreading plates are disposed spaced supporting ribs for securing the spreading plates, the spreading device having a central shaft seat fixedly secured to the shaft seat of the wind guiding device by a fastening member to synchronously rotate therewith; and a supporting device which is a wheel-like body having a central seat portion rotatably connected with the fastening member between the wind guiding device and the spreading device, whereby the wind guiding device and the spreading device can be supported by and rotated about the seat portion, the seat portion being disposed with a retaining member, the edges of the supporting device being connected with a periphery of the wind exit of an air-conditioning system.

2. A wind blowing apparatus as claimed in claim 1, wherein the supporting device is located between the wind guiding device and the spreading device.

3. A wind blowing apparatus as claimed in claim 1, wherein the wind guiding device is a flat wheel-like body.

4. An electricity-free rotary wind blowing apparatus comprising a wind guiding device, a spreading device and a supporting device, wherein the supporting device has a central seat portion disposed with an inner retaining member, the spreading device being disposed with multiple inner concentrical annular spreading guiding plates and the wind guiding device being disposed with multiple inner radial inclined vanes, the spreading device and the wind guiding device being rotatably connected with the retaining member by a shaft to synchronously rotate.

5. A wind blowing apparatus as claimed in claim 4 wherein the wind guiding device is located between the spreading and the supporting device.

6. A wind blowing apparatus as claimed in claim 4, wherein the spreading device is located between the wind guiding device and the supporting device.

7. A wind blowing apparatus as claimed in claim 4, wherein the spreading device is located under the wind guiding device.

8. A wind blowing apparatus as claimed in claim 4, wherein the wind guiding device is located under the spreading device.

9. A wind blowing apparatus as claimed in claim 4, wherein the wind guiding device is directly disposed in the spreading device as radial vanes integrally connected with the spreading guiding plates thereof.

10. A wind blowing apparatus as claimed in claim 4, wherein the spreading guiding plates of the spreading device are connected with each other by multiple supporting ribs disposed therebetween.

11. A wind blowing apparatus as claimed in claim 5, wherein the spreading guiding Plates of the spreading device are connected with each other by multiple supporting ribs disposed therebetween.

12. A wind blowing apparatus as claimed in claim 6, wherein the spreading guiding plates of the spreading device are connected with each other by multiple supporting ribs disposed therebetween.

13. A wind blowing apparatus as claimed in claim 7, wherein the spreading guiding plates of the spreading device are connected with each other by multiple supporting ribs disposed therebetween.

14. A wind blowing apparatus as claimed in claim 8, wherein the spreading guiding plates of the spreading device are connected with each other by multiple supporting ribs disposed therebetween.

* * * * *